US012420971B2

(12) United States Patent
Lalonde et al.

(10) Patent No.: US 12,420,971 B2
(45) Date of Patent: Sep. 23, 2025

(54) LINER FOLDER APPARATUS

(71) Applicant: INNOVATIVE AUTOMATION INC., Barrie (CA)

(72) Inventors: Michael Lalonde, Barrie (CA); Zac Cutt, Barrie (CA)

(73) Assignee: INNOVATIVE AUTOMATION INC., Barrie (CA)

( * ) Notice: Subject to any disclaimer, the term of this patent is extended or adjusted under 35 U.S.C. 154(b) by 110 days.

(21) Appl. No.: 18/560,439

(22) PCT Filed: May 11, 2022

(86) PCT No.: PCT/CA2022/050744
§ 371 (c)(1),
(2) Date: Nov. 13, 2023

(87) PCT Pub. No.: WO2022/236417
PCT Pub. Date: Nov. 17, 2022

(65) Prior Publication Data

US 2024/0253841 A1 Aug. 1, 2024

Related U.S. Application Data

(60) Provisional application No. 63/187,721, filed on May 12, 2021.

(51) Int. Cl.
*B65B 51/06* (2006.01)
*B65H 45/08* (2006.01)

(52) U.S. Cl.
CPC ..... *B65B 51/06* (2013.01); *B65H 45/08* (2013.01); *B65H 2701/377* (2013.01)

(58) Field of Classification Search
CPC ..... B25B 27/0092; Y02W 30/62; B65H 2301/5151; B65H 2301/51532; B65H 2701/377; B65H 45/08; B65B 51/06
See application file for complete search history.

(56) References Cited

U.S. PATENT DOCUMENTS 4,298,148 A 11/1981 Gakiya
4,696,707 A 9/1987 Lewis et al.
(Continued)

FOREIGN PATENT DOCUMENTS

WO 2021/087622 5/2021

OTHER PUBLICATIONS

Translation of JP2001226517A.*
(Continued)

*Primary Examiner* — Sonya M Sengupta
(74) *Attorney, Agent, or Firm* — Grossman, Tucker, Perreault & Pfleger, PLLC

(57) ABSTRACT

A folding apparatus for a liner associated with a tape material, wherein the liner comprises a first overhang portion, a central portion carrying the tape material, and a second overhang portion, the apparatus comprising: an entry port defined at one end of the apparatus, wherein the tape material having a substantially flat configuration is fed into the entry port; an exit port defined at another end of the apparatus; a channel defined between the entry port and the exit port, wherein the channel comprises walls engageable by a first edge of the first overhang portion and a second edge of the second overhang portion to progressively cause the first edge portion and the second edge to angle towards each other as the tape material with the liner progress towards the exit port until the overhang portions are folded over the tape material.

20 Claims, 6 Drawing Sheets

(56) References Cited

U.S. PATENT DOCUMENTS

| | | | | |
|---|---|---|---|---|
| 9,833,030 | B1 | 12/2017 | Chang | |
| 2010/0292064 | A1 | 11/2010 | Hatcher et al. | |
| 2024/0253841 | A1* | 8/2024 | Lalonde | B65B 51/06 |

OTHER PUBLICATIONS

International Search Report from corresponding PCT/CA2022/050744, dated Aug. 10, 2022.
Written Opinion from corresponding PCT/CA2022/050744, dated Aug. 10, 2022.

* cited by examiner

LINER FOLDER APPARATUS

FIELD

Aspects of this disclosure relate to relates to a tape applicator apparatus.

BACKGROUND

Adhesive-backed tape is commonly applied to body surfaces, interior and exterior claddings and panels (e.g. trim, moldings, covers, trays, panels, doors and hatches) of a vehicle (e.g., an automobile, aircraft, or watercraft), or structures (e.g. buildings, HVAC units). For example, an adhesive-backed tape mounted around the periphery of a cladding on a vehicle component provides a seal which helps to control water intrusion, and reduce cabin noise due to wind when the vehicle is in motion, as well as control dust intrusion into the cabin and engine parts. Such tapes may be manually installed, however such a process is not only slow, but labour intensive, and prone to human error. In addition, the application process may not be uniform, predictable or reproducible.

Several methods have been proposed to apply adhesive-backed tape on substrates, such as those employing robotic end effectors or fixed applicators. However, these methods suffer from several challenges, such as, inaccurate placement of the adhesive tape, constant cycle interruptions due to jams within the equipment, tape breakages due to lack of adequate tension control, and the inevitable downtime due to spool changes during a production cycle. Furthermore, industry adoption of automated applicator equipment has been slow for numerous reasons such as: application geometry constraints (i.e. having a large roll mounted on the applicator head), speed and volume of application, as the roll size is limited, cell design constraints. In addition, existing equipment is typically only capable of holding/dispensing rolls of tape that are less than 32a meters in length, and therefore this equipment is incapable of keeping up with the production demands.

Level wound spools are normally required to continuously feed the high volume tape application equipment, however, level wound spools are not overly common, most double sided tape is provided in a single cut 'pancake roll' which is very limited in length. Level wound spools involve the joining of a number of pancake rolls into one continuous spool. Commercially available double sided tape, such as acrylic foam tapes, VHB, typically include a liner overhang of liner on each side of the tape material. One type commercially available level wound spool uses a standard 25 mm cover liner regardless of tape size which varies between 5 mm and 16 mm in width. Accordingly, the liner overhang may range from 4.5 mm to 10 mm per side. The liner overhang is generally included by the manufacturers to prevent 'knitting' or the gluing together of edges of the tape material on the roll, and to add stability to the roll when winding as the rolls generally do not have end caps but rather a tapered design. In the event that the edges do knit back together, the tape can be rendered unusable as it will not peel off in strip format or feed through the tape applicator equipment, such as robotic end effectors, fixed applicators or other tools. However, the liner overhang may cause problems with the operation of the tape dispensing or feeding equipment and application equipment, such as jamming of the tape within the applicator equipment. These problems have forced some end users of the commercially available level wound spool to painstakingly reduce the size of the liner overhang before use in their equipment in order to avoid the aforementioned jamming problems. However, this process is inefficient, laborious, costly, and often leads to inconsistent results.

SUMMARY

In one of its aspects, a liner folding apparatus for a liner associated with a tape material, wherein the liner comprises a first overhang portion, a central portion carrying the tape material, and a second overhang portion, the apparatus comprising:

- an entry port defined at one end of the apparatus, wherein the central portion carrying the tape material, the first overhang portion and the second overhang portion is received by the entry port in a substantially flat configuration;
- an exit port defined at another end of the apparatus; and
- a channel defined between the entry port and the exit port, wherein the channel comprises walls engageable by a first edge of the first overhang portion and a second edge of the second overhang portion to progressively cause the first edge of the first overhang portion and the second edge of the second overhang portion to angle towards each other as the tape material with the liner progress towards the exit port until the first overhang portion and the second overhang portion are folded over the tape material.

In another of its aspects, a liner folder apparatus for a liner associated with a tape material, the apparatus comprising:

- a liner overhang deflector portion with an entry port for the liner;
- a folding portion;
- a tapered portion with an exit port for the liner; and
- a channel defined between the entry port and the exit port.

In another of its aspects, a method of folding a liner associated with a tape material, wherein the liner comprises a first overhang portion, a central portion carrying the tape material, and a second overhang portion, the method comprising:

- feeding the liner in a substantially flat configuration into an entry port defined at one end of a folding apparatus, wherein the entry port is coupled to a channel extending from the entry port to an exit port defined at another end of the apparatus; and
- guiding the first overhang portion and the second overhang portion within the channel comprising walls engageable by a first edge of the first overhang portion and a second edge of the second overhang portion to progressively cause the first edge of the first overhang portion and the second edge of the second overhang portion to angle towards each other as the tape material with the liner progress towards the exit port until the first overhang portion and the second overhang portion are folded over the tape material.

Advantageously, the liner folder apparatus may be installed on a plurality of commercially available tape applicator equipment, such as robotic end effectors, fixed applicators or other tools, and allows tape applicator equipment to maintain the original design specifications which further enhances the equipment's agility by facilitating access to narrow or hard to reach areas. The liner folder apparatus allows standard, commercially available rolls or spools to be used with the tape applicator equipment, such as robotic end effectors, fixed applicators or other tools, thereby eliminating the need to customize the tape material by removing excess liner. Accordingly, the liner folder apparatus allows for faster application rates of the tape material, increased efficiency, reduced labor costs and substantial cost savings. In addition, the extended liner left on the liner folder apparatus, when folded over the tape material, creates a convenient tab to pull and remove the liner, thereby eliminating a separate process that adds a tab to the tape product for liner removal.

BRIEF DESCRIPTION OF THE DRAWINGS

Several exemplary embodiments of the present invention will now be described, by way of example only, with reference to the appended drawings in which.

DETAILED DESCRIPTION

Figure 1:
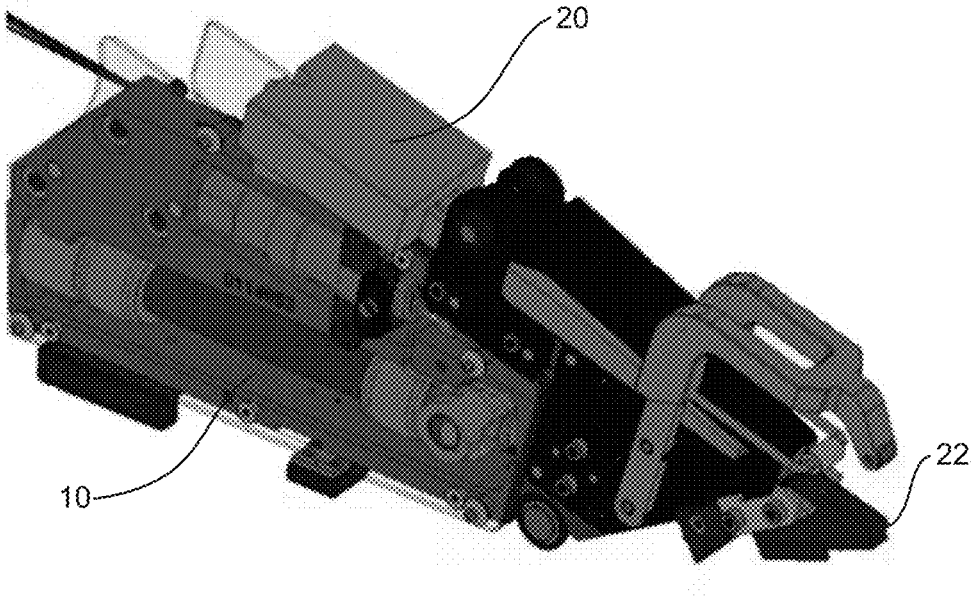
FIG. 1 shows an isometric view of an exemplary tape applicator head with a liner folder apparatus installed thereon.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Like reference numerals are used to designate like parts in the accompanying drawings.

The detailed description provided below in connection with the appended drawings is intended as a description of the present examples and is not intended to represent the only forms in which the present example may be constructed or used. However, the same or equivalent functions and sequences may be accomplished by different examples.

Figure 2A:
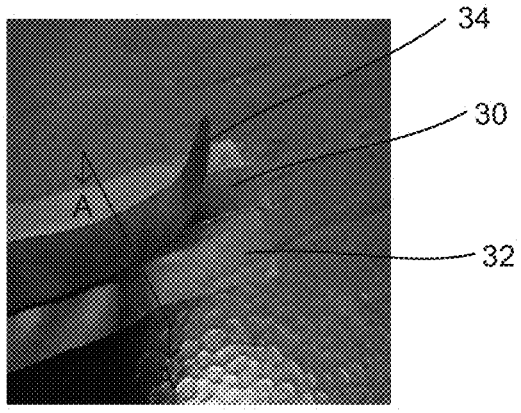
FIG. 2*a* shows an exemplary tape.

Referring to FIG. 1, there is shown a tape applicator head for attaching an adhesive tape to a receiving surface or a substrate, generally identified by numeral 10, in an exemplary embodiment. Liner folder apparatus 20 is removably attached to adhesive tape applicator head 10, adjacent to tip 22 of adhesive tape applicator head 10. FIG. 2*a* shows adhesive tape material 30 with tape liner 32 and backing 34. In one example, adhesive lined tape 30 is conveyed to liner folder apparatus 20 installed on adhesive tape applicator head 10 which applies adhesive lined tape 30 to a receiving surface or a substrate. In one example, adhesive tape applicator head 10 is mounted on a robotic arm of an industrial robot with various axis configurations. For example, the industrial robot may include have six axes, or six degrees of freedom, which allow for greater flexibility.

Figure 2B:
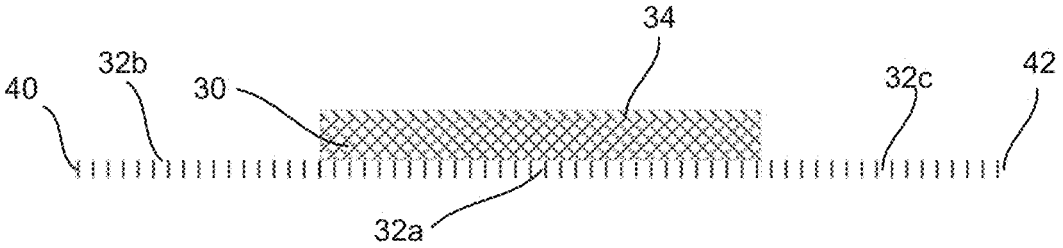
FIG. 2*b* shows a sectional view of the exemplary tape of FIG. 2*a* taken along line A-A.
Figure 2C:
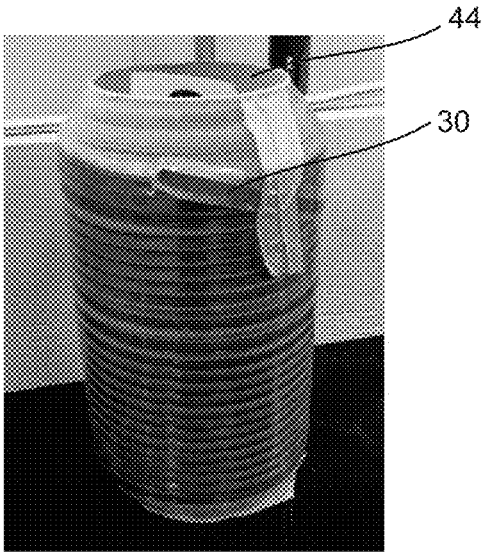
FIG. 2*c* shows a level wound spool of the exemplary tape.

Examples of adhesive lined tape 30, include, but are not limited to, crushed ethylene propylene diene monomers (EPDM); neoprene closed cell; expanded polyvinyl chloride (PVC); polyethylene; acrylic foam tapes (e.g. very high bond (VHB) tape)). In one example, tape liner 32 comprises a unitary body with central liner portion 32*a* with adhesive tape material 30 and first liner overhang portion 32*b* and second liner overhang portion 32*c* on either side of tape material 30, as can be seen in FIG. 2*b*. The width of first liner overhang portion 32*b* or second liner overhang portion 32*c* may vary in size. In one example, the width of first liner overhang portion 32*b* or second liner overhang portion 32*c* may range between 5 mm and 10 mm. First liner overhang portion 32*b* comprises edge 40 and second liner overhang portion 32*c* comprises edge 42. FIG. 2*c* shows a level wound spool 44 of adhesive lined tape 30.

Figure 3A:
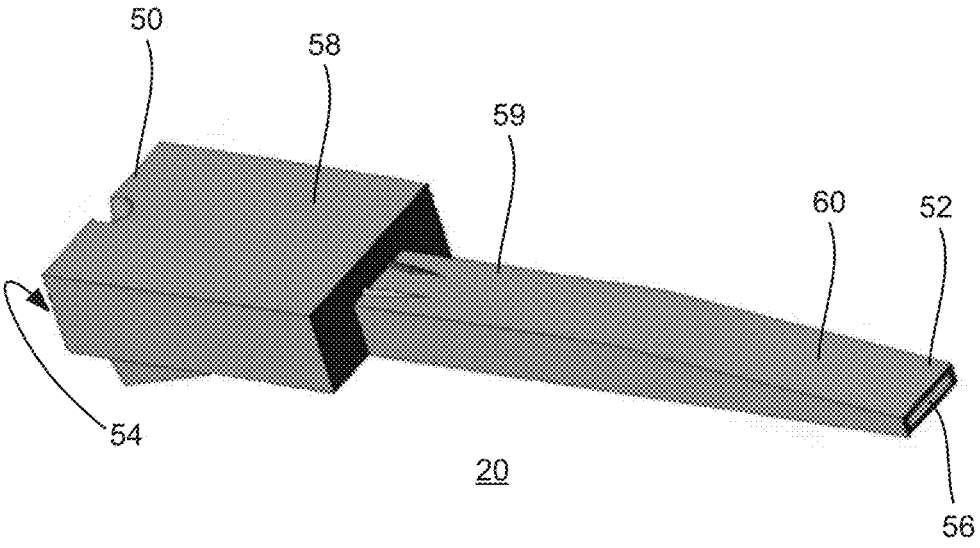
FIG. 3*a* shows an isometric view of the liner folder apparatus.
Figure 3B:
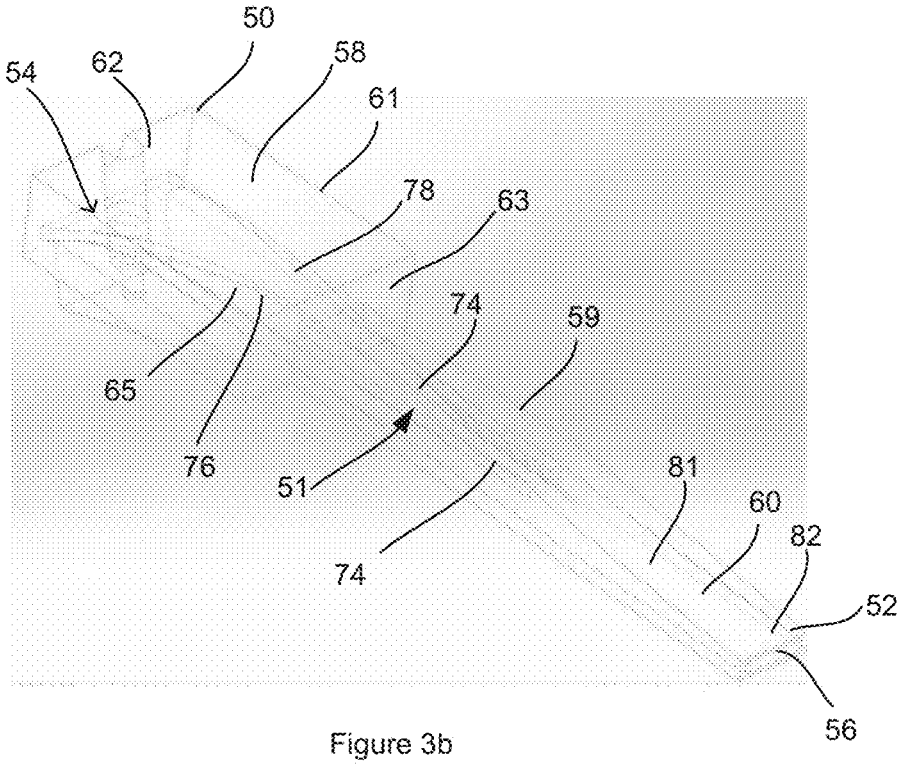
FIG. 3*b* shows a transparent view of the liner folder apparatus.
Figure 3C:
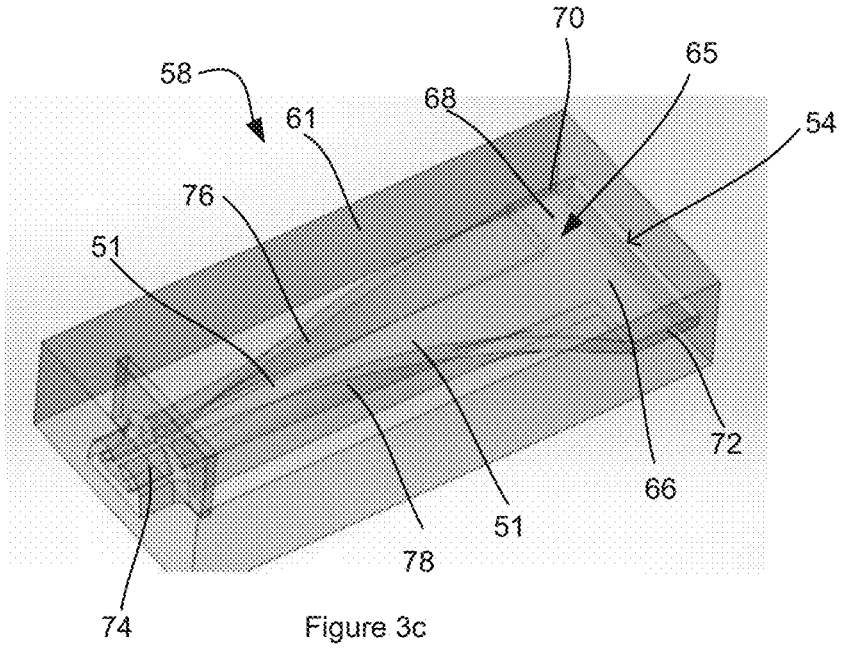
FIG. 3*c* shows a transparent partial view of the liner folder apparatus.

As can be seen in FIGS. 3*a*-3*c*, liner folder apparatus 20 dimensioned to receive flat adhesive tape material 30 at one end 50, guide tape material 30 via channel 51, and output folded tape material 30 at another end 52. folding portion 59 tapered portion 60 According, central liner portion 32*a*, first liner overhang portion 32*b* and second liner overhang portion 32*c* in a flat configuration, as shown in FIG. 3*b*, is introduced into entry port 54 at end 50, and transported along channel 51. First liner overhang portion 32*b* and second liner overhang portion 32*c* are progressively folded over central liner portion 32*a* as tape material 30 traverses channel 51 before exiting from exit port 56.

Liner folder apparatus 20 comprises liner overhang deflector portion 58, folding portion 59 and tapered portion 60. As can be seen in FIG. 3*b*, deflector portion 58 comprises body 61 with a proximal end 62 and a distal end 63. The proximal end 62 comprises an entry port 54 leading into curved, deflector channel 65 defined by bottom wall 66, top wall 68, first side wall 70 and second side wall 72. Starting from entry port 54, first side wall 70 and second side wall 72 steadily converge towards each other such that the width of bottom wall 66 adjacent intermediary channel 74, adjacent to the distal end 63, is less than the width of bottom wall 66 adjacent entry port 54. Correspondingly, the width of top wall 68 adjacent intermediary channel 74 is less than the width of top wall 66 adjacent entry port 54. Accordingly, curved walls 76, 78 are formed from bottom wall 66 within liner overhang deflector portion 58 such that first liner overhang portion 32*b* and second liner overhang portion 32*c* are guided along curved walls 76, 78, respectively. Liner overhang deflector portion 58 gradually deflects first liner overhang portion 32*b* and second liner overhang portion 32*c* from a first position, in which the edges of first liner overhang portion 32*b* and second liner overhang portion 32*c* are opposed to each other and disposed substantially 180 degrees to each other, into an intermediary position in which first liner overhang portion 32*b* and second liner overhang portion 32*c* are angled away from central liner portion 32*a*.

Folding portion 59 comprises intermediary channel 74 in which curved walls 76, 78 gradually curve towards each other to eventually substantially face each into a substantially C-shape configuration as channel 51 progresses towards tapered portion 60. Accordingly, folding portion 59 transforms first liner overhang portion 32*b* and second liner overhang portion 32*c* from the intermediary position into a folding position in which edge 32*c* of first liner overhang portion 32*b* and edge 40 of second liner overhang portion 32*c* are angled towards each other.

C-shaped channel 74 is gradually transformed into D-shaped channel 81 and ultimately into rectangular channel 82 as channel 51 progress towards exit port 56. Accordingly, tapered portion 60 transforms first liner overhang portion 32*b* and second liner overhang portion 32*c* from folding position into a folded position, in which edges 40, 42 of first liner overhang portion 32*b* and second liner overhang portion 32*c*, respectively, converge towards each other, such that upon exit edges 40, 42 of first liner overhang portion 32*b* and second liner overhang portion 32*c*, respectively, substantially face each other.

Figure 4A:
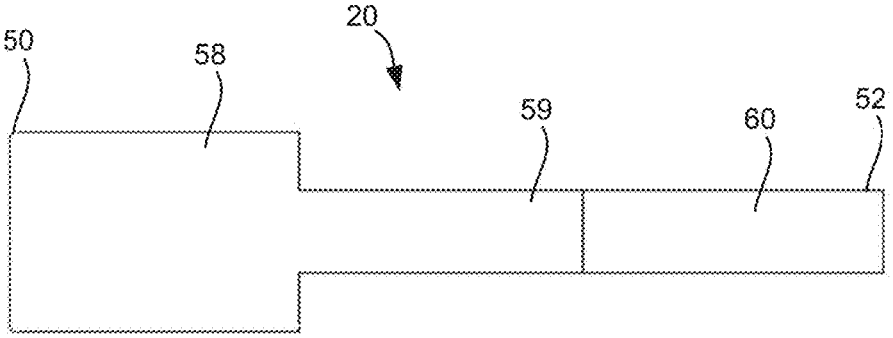
FIG. 4*a* shows a top view of the liner folder apparatus.

FIG. 4*a* shows a top view of liner folder apparatus 20 with liner overhang deflector portion 58, folding portion 59 and tapered portion 60.

Figure 4B:
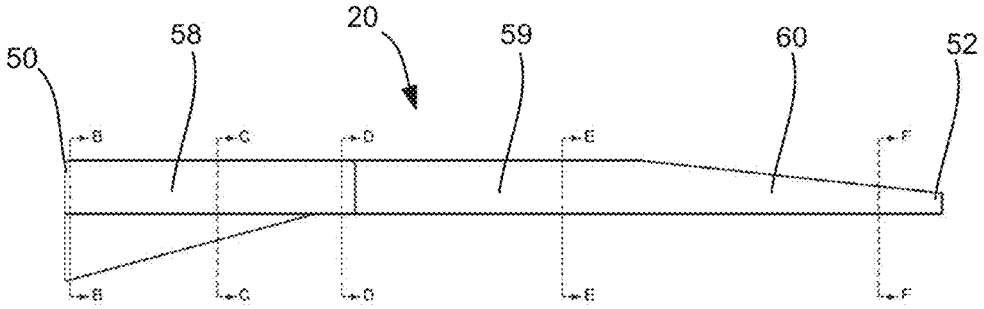
FIG. 4*b* shows a right side view of the liner folder apparatus.

FIG. 4*b* shows a side view of liner folder apparatus 20 with liner overhang deflector portion 58, folding portion 59 and tapered portion 60.

Figure 5B:
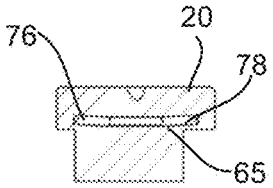
FIG. 5*b* is a sectional view of the liner folder apparatus liner taken along line B-B in FIG. 5*a;*
Figure 5C:
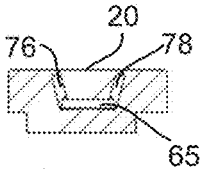
FIG. 5*c* is a sectional view of the liner folder apparatus taken along line C-C in FIG. 5*a;*
Figure 5D:
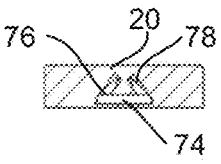
FIG. 5*d* is a sectional view of the liner folder apparatus liner taken along line D-D in FIG. 5*a;*
Figure 5E:
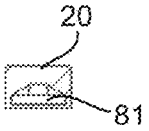
FIG. 5*e* is a sectional view of the liner folder apparatus liner taken along line E-E in FIG. 5*a;*
Figure 5F:
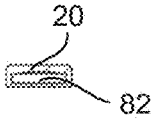
FIG. 5*f* is a sectional view of the liner folder apparatus liner taken along line F-F in FIG. 5*a;*
Figure 5A:
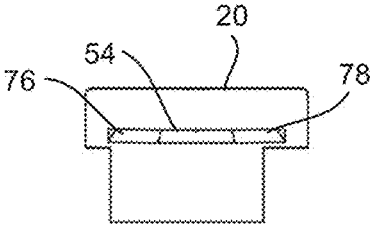
FIG. 5*a* shows a rear view of the liner folder apparatus.
Figure 6A:
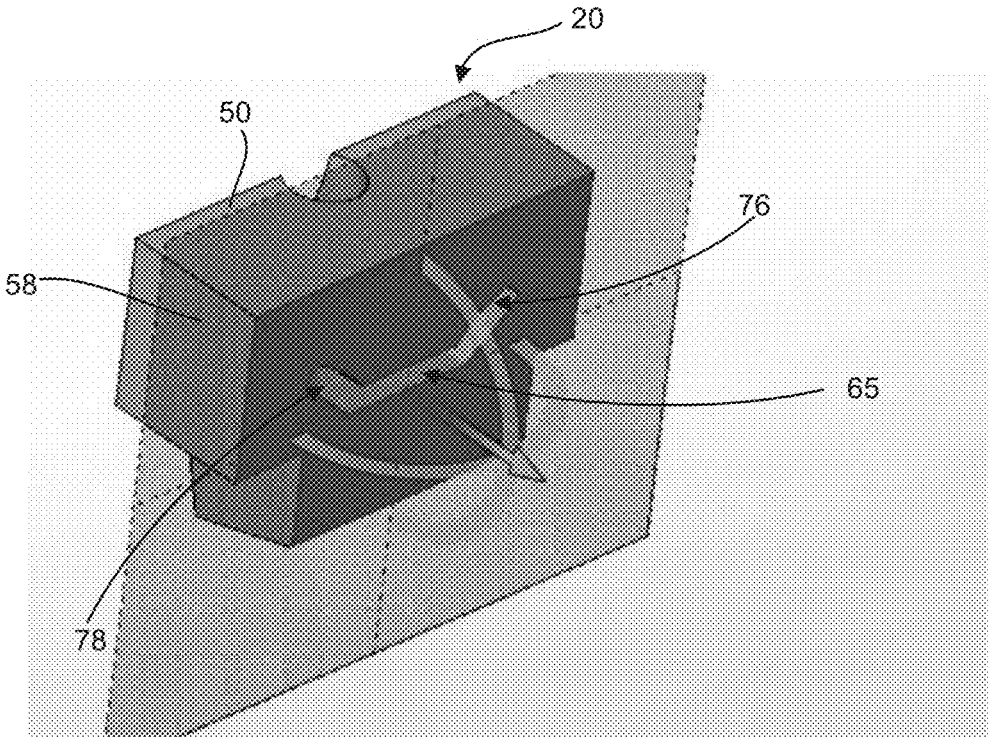
FIG. 6*a* is a sectional view of a deflector portion of the liner folder apparatus liner.
Figure 6B:
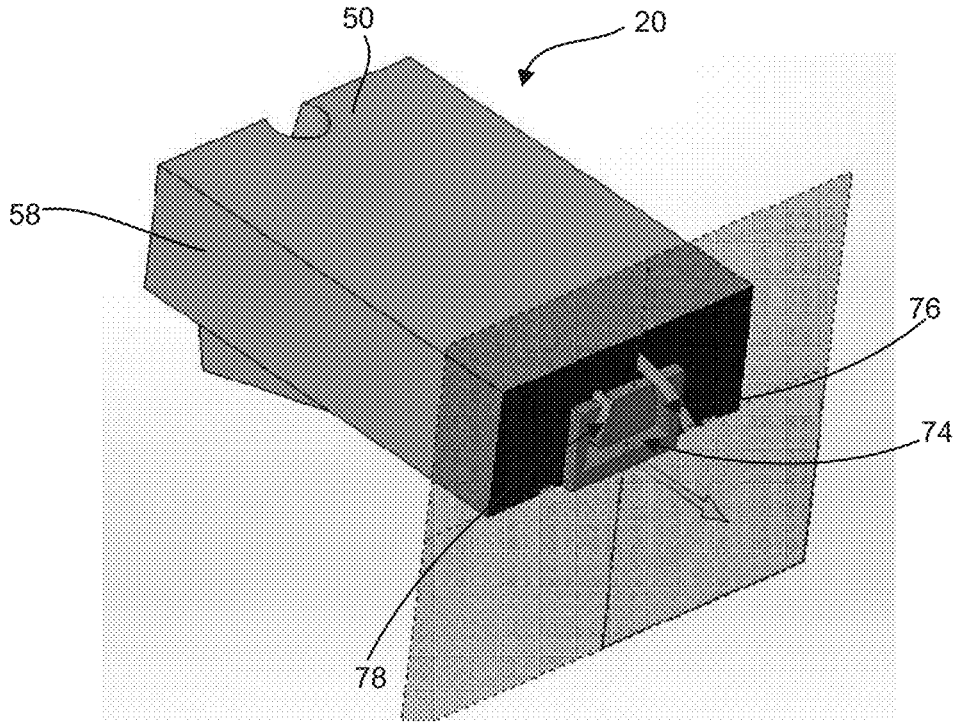
FIG. 6*b* is a sectional view of a folding portion of the liner folder apparatus; liner.

FIG. 5*a* shows a rear view of liner folder apparatus 20, showing entry port 54 and curved walls 76, 78.

FIG. 5*b* is a sectional view of liner folder apparatus 20 liner taken along line B-B in FIG. 5*a*, and showing entry port 54 and curved walls 76, 78.

FIG. 5*c* is a sectional view of liner folder apparatus 20 taken along line C-C in FIG. 5*a*, and showing liner curved walls 76, 78.

FIG. 5*d* is a sectional view of liner folder apparatus 20 liner taken along line D-D in FIG. 5*a*, and showing C-shaped channel 74.

FIG. 5*e* is a sectional view of liner folder apparatus 20 liner taken along line E-E in FIG. 5*a*, and showing D-shaped channel 81.

FIG. 5*f* is a sectional view of liner folder apparatus 20 liner taken along line F-F in FIG. 5*a*, and showing rectangular channel 82 at exit port 56.

Figure 7A:
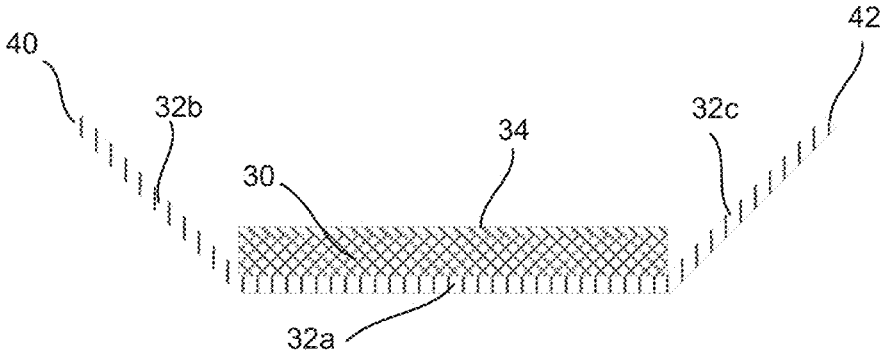
FIG. 7*a* shows a sectional view of the exemplary tape within the deflector portion of the liner folder apparatus.
Figure 7B:
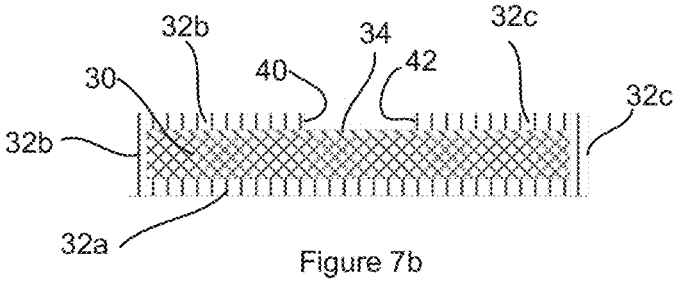
FIG. 7*b* shows a sectional view of the exemplary tape within the tapered portion of the liner folder apparatus.

As can be seen from the cross sectional views of FIGS. 5*b*-5*f*, 6*a* and 6*b*, substantially flat adhesive tape material 30 with first liner overhang portion 32*b* and second liner overhang portion 32*c*, as can be seen in FIG. 2*b*, is introduced into channel 51 at one end 50, and as tape material 30 progress through channel 51 first liner overhang portion 32*b* and second liner overhang portion 32*c* are progressively folded, as can be seen in FIG. 7*a*, such that first liner overhang portion 32*b* and second liner overhang portion 32*c* are eventually disposed over tape material 30 to form a sandwich, as can be seen in FIG. 7*b*.

Subsequently, sandwiched tape material 30 may be severed as need by a severing mechanism associated with a tape applicator head, or the like. For example, sandwiched tape material 30 may be severed by a blade.

In another implementation, other configurations of channel 51 may be implemented for other desired folds.

In another implementation, liner folder apparatus 20 may include a plurality of components capable of being assembled together, such that each of the components may comprise different channel 51 configurations and dimensions to facilitate a variety of folding configurations of first liner overhang portion 32*b* and second liner overhang portion 32*c* with respect to tape material 30.

In another implementation, liner folder apparatus 20 may include a plurality of components capable of being assembled together, or capable of being disassembled to facilitate cleaning or service, or for loading new material 30.

In another implementation, liner folder apparatus 20 may include a device within channel 51 and/or channel configurations for substantially eliminating jamming of tape material 30 within channel 51 and/or other channel configurations.

In another implementation, liner folder apparatus 20 may be manufactured from different materials, such as metals, plastics, paper or composites.

In another implementation, liner folder apparatus 20 may comprise other means of folding, such as air assistance, forcing air into channel 51, or mechanical moving components.

In another implementation, liner folder apparatus 20 comprises a spiral channel which steadily decreases in flow direction with increasing length of the spiral channel.

The benefits and advantages described above may relate to one embodiment or may relate to several embodiments. The embodiments are not limited to those that solve any or all of the stated problems or those that have any or all of the stated benefits and advantages. The operations of the methods described herein may be carried out in any suitable order, or simultaneously where appropriate. Additionally, individual blocks may be added or deleted from any of the methods without departing from the spirit and scope of the subject matter described herein. Aspects of any of the examples described above may be combined with aspects of any of the other examples described to form further examples without losing the effect sought.

The above description is given by way of example only and various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A folding apparatus for a liner associated with a tape material, wherein the liner comprises a first overhang portion, a central portion carrying the tape material, and a second overhang portion, the apparatus comprising:

an entry port defined at one end of the apparatus, wherein the central portion carrying the tape material, the first overhang portion and the second overhang portion is received by the entry port in a substantially flat configuration;

an exit port defined at another end of the apparatus; and a channel defined between the entry port and the exit port, wherein the channel comprises walls engageable by a first edge of the first overhang portion and a second edge of the second overhang portion to progressively cause the first edge of the first overhang portion and the second edge of the second overhang portion to angle towards each other as the tape material with the liner progress towards the exit port until the first overhang portion and the second overhang portion are folded over the tape material.

2. The folding apparatus of claim 1, comprising curved walls adjacent to the entry port for urging the first overhang portion and the second overhang portion from the substantially flat configuration to an angled configuration wherein the first overhang portion and the second overhang portion are angled away from the central portion.

3. The folding apparatus of claim 1, comprising tapered walls adjacent to the exit port for urging the first overhang portion and the second overhang portion from the angled configuration to a folded configuration in which the first edge of the first overhang portion and the second edge of the second overhang portion face each other.

4. The folding apparatus of claim 1, wherein the folding apparatus is associated with a tape applicator apparatus for applying the tape material to a receiving surface.

5. The folding apparatus of claim 4, wherein the folding apparatus is removably attached to the tape applicator apparatus for applying the tape material to a receiving surface.

6. The folding apparatus of claim 4, wherein the tape material comprises at least one of crushed ethylene propylene diene monomers (EPDM), neoprene closed cell, expanded polyvinyl chloride (PVC), polyethylene, acrylic foam tapes and very high bond (VHB) tapes.

7. A liner folder apparatus for a liner associated with a tape material, the apparatus comprising:

a liner overhang deflector portion with an entry port for the liner;

a folding portion;

a tapered portion with an exit port for the liner;

a channel defined between the entry port and the exit port; and wherein at least one of the deflector portion, the folding portion and the tapered portion is capable of being disassembled to facilitate cleaning or service, or for loading of the tape material.

8. The liner folder apparatus of claim 7, wherein the liner is introduced into the entry port in a substantially flat configuration, and is fed through the liner overhang deflector portion, the folding portion, and the tapered portion.

9. The liner folder apparatus of claim 8, wherein the channel is differently dimensioned between the entry port and the exit port.

10. The liner folder apparatus of claim 7, wherein the channel is spiral-shaped.

11. The liner folder apparatus of claim 7, further comprising at least one of air resistance for facilitating folding of the liner and mechanical moving components for facilitating folding of the liner.

12. A method of folding a liner associated with a tape material, wherein the liner comprises a first overhang portion, a central portion carrying the tape material, and a second overhang portion, the method comprising:

feeding the liner in a substantially flat configuration into an entry port defined at one end of a folding apparatus, wherein the entry port is coupled to a channel extending from the entry port to an exit port defined at another end of the apparatus;

guiding the first overhang portion and the second overhang portion within the channel comprising walls engageable by a first edge of the first overhang portion and a second edge of the second overhang portion to progressively cause the first edge of the first overhang portion and the second edge of the second overhang portion to angle towards each other as the tape material with the liner progress towards the exit port until the first overhang portion and the second overhang portion are folded over the tape material; and wherein the folding apparatus is associated with a tape applicator apparatus for applying the tape material to a receiving surface.

13. The method of claim 12, wherein the folding apparatus comprises curved walls adjacent to the entry port for urging the first overhang portion and the second overhang portion from the substantially flat configuration to an angled configuration wherein the first overhang portion and the second overhang portion are angled away from the central portion.

14. The method of claim 13, wherein the folding apparatus comprises tapered walls adjacent to the exit port for urging the first overhang portion and the second overhang portion from the angled configuration to a folded configuration in which the first edge of the first overhang portion and the second edge of the second overhang portion face each other.

15. The method of claim 13, wherein the folding apparatus is removably attached to a tape applicator apparatus for applying the tape material to a receiving surface.

16. The method of claim 14, wherein a first channel portion adjacent to the entry port is of a rectangular configuration of a first size.

17. The method of claim 14, wherein a second channel portion between the entry port and the exit port is of a C-shape configuration.

18. The method of claim 14, wherein a third channel portion between the entry port and the exit port is of a D-shape configuration.

19. The method of claim 14, wherein a fourth channel portion adjacent to exit port is of a rectangular configuration of a second size.

20. The method of claim 16, wherein the first size of the first channel portion is greater than the second size of the fourth channel portion.

* * * * *